United States Patent [19]

Thevis

[11] 4,450,751

[45] May 29, 1984

[54] FIRE LIMITER FOR AUTOMATIC FIREARMS WITH HAMMER BLOW DETONATION

[75] Inventor: Paul Thevis, Oberndorf, Fed. Rep. of Germany

[73] Assignee: Heckler & Koch GmbH, Oberndorf, Fed. Rep. of Germany

[21] Appl. No.: 373,722

[22] Filed: Apr. 30, 1982

[30] Foreign Application Priority Data

May 20, 1981 [DE] Fed. Rep. of Germany ..... 3120128

[51] Int. Cl.[3] ..... F41D 11/10

[52] U.S. Cl. ..... 89/129 B

[58] Field of Search ..... 89/128, 129 B

[56] References Cited

U.S. PATENT DOCUMENTS 3,292,492 12/1966 Sturtevant ..... 89/128

FOREIGN PATENT DOCUMENTS 1121981 1/1962 Fed. Rep. of Germany .... 89/129 B
1297002 1/1970 Fed. Rep. of Germany .
2136101 7/1976 Fed. Rep. of Germany .
2201451 4/1974 France .
446126 3/1968 Switzerland .
626717 11/1981 Switzerland .

*Primary Examiner*—Stephen C. Bentley
*Attorney, Agent, or Firm*—Burmeister, York, Palmatier, Hamby & Jones

[57] ABSTRACT

In a fire limiter for automatic firearms with hammer blow detonation, a pawl (38) is supported pivotally directly on a bearing on the hammer arranged eccentrically to the latter's pivoting axis (1). The pawl transfers essentially the entire striking motion of the hammer to a wheel ratchet, which at every shot rotates by one tooth and is held in any given position by a spring-loaded stop pawl. The wheel ratchet is provided with a cam which, after a predetermined number of intermittent stops, activates a fire disconnector which preferably comprises a trip-releasing catch (26), supported pivotally on the trigger (16), and a sear (12), supported pivotally on the same shaft (14) as the trigger (16). The catch (26) initially latches the sear (12) and is pulled away from the sear (12) by the wheel ratchet, whereby the sear is released to drop into a detent (11) on the hammer (2).

15 Claims, 4 Drawing Figures

FIRE LIMITER FOR AUTOMATIC FIREARMS WITH HAMMER BLOW DETONATION

FIELD OF THE INVENTION

This invention concerns a fire limiter for automatic firearms with hammer blow detonation, especially hand firearms, with a wheel ratchet that at each shot is turned one tooth by a pawl whose movement is derived from the movement of the hammer, the ratchet being held in any given position by a spring loaded stop pawl and being provided with a control cam which after a predetermined number of intermittent advances activates a fire disconnector.

BACKGROUND OF THE INVENTION

Such a fire limiter is known from German Pat. No. 21 36 101. In the known fire limiter, the activation of the stop pawl takes place through a rod linked with the hammer, on which rod a compression spring loading the hammer is arranged. Each time, toward the end of the cocking movement of the hammer, the end of the rod penetrating a spring abutment, impacts on an arm of the pawl and thereby pivots the pawl, which drives the wheel ratchet with its pivoting movement.

From German Pat. No. 12 97 002, another fire limiter for automatic firearms with hammer blow detonation is known, in which not a wheel ratchet, but a linearly movable ratchet rod is provided, which is moved by an actuating pawl and held in a given position by a spring-loaded stop pawl. In this known fire limiter, the hammer itself is engaged with the actuating pawl at the end of its cocking motion and transmits its motion to the motion of the pawl which in turn drives the ratchet rod.

In both known fire limiters, the advance of the wheel ratchet or the ratchet rod takes place on the last part of the cocking motion of the hammer caused by the breech recoil of the firearm. Here sudden violent stresses appear that put a lot of strain on the fire limiter and the parts that work with it. Also, bouncing effects can occur that adversely affect the operating reliability of the fire counter.

SUMMARY OF THE INVENTION

The object of the invention is, therefore, so to design a fire limiter of the type mentioned at the beginning that the stress on it is decreased and its operating reliability is increased.

This object of the invention is achieved by having a pawl remain in solid driven connection with the hammer and transmit essentially the entire motion of the hammer running in one direction to the ratchet wheel.

The utilization of the entire hammer motion running in one direction leads to a considerable increase in the duration of the movement and thereby a significant decrease in the stepping speed, whereby excess acceleration and the application of excessive forces are avoided that would otherwise have to be produced for achieving the high accelerations. Since the movements do not now have to occur as suddenly and violently as before, there is more time for the engagement of the spring-loaded stop pawl, so that the spring loading of this pawl can also be decreased and its engagement time increased, whereby the danger of failures or errors in the movement travel and in the shot counting is decreased.

In a preferred embodiment of the invention, the pawl drives the wheel ratchet with the striking motion of the hammer. The striking motion of the hammer occurs under the influence of the striker spring that loads the hammer and is therefore determined exclusively by the design of the weapon, differently from the cocking process, taking place under the influence of the breech recoil, which to a high degree depends on the type of ammunition fired.

Therefore, in the utilization of the striking movement of the hammer an accurate constructional design setting as to the timing of the stepping action of the fire limiter during the course of the hammer movement, is possible, leading to the optimum operation of the fire limiter. Moreover, the utilization of the striking movement of the hammer also is favorable for the interruption of the firing, because after the forward movement of the fire limiter the entire return time of the breech is available to prepare the members controlled by the wheel ratchet for the interruption of the firing to catch the cocked hammer.

The utilization of the entire movement of the hammer running in one direction for the forward movement of the wheel ratchet can take place in a simple manner by having the pawl mounted pivotally directly on a bearing arranged on the hammer eccentrically to its swivel axis. By means of the arrangement of this bearing, the magnitude and the temporal duration of the step motion of the pawl can be optimally adjusted to the hammer movement. Furthermore, in this way additional intermediary components are avoided that complicate the movements and increase the masses to be moved. The eccentric bearing can have a relatively large diameter, so that the forces arising in the stepping process can be absorbed over a large area.

A particularly simple and space-saving embodiment of such a fire limiter can be obtained by loading the pawl and the wheel ratchet with a common compression spring that is arranged between two approximately parallel arms arranged on the pawl and on the wheel ratchet. The spring tends to keep the pawl engaged with the wheel ratchet and at the same time tends to return the wheel ratchet to its initial position. The compression spring can be arranged on a spring rod, articulated on the arm of the wheel ratchet and penetrating an opening in the arm of the pawl.

The above-mentioned relatively low speed of the ratchet movement also makes it possible to effect the fire interruption in a manner which is both simple and especially reliable, without the necessity of any considerable incursions into a known trigger system that can be adjusted for single shot and continuous fire and has a sear working with the hammer that pivots on the same axis as the trigger. Even the above-mentioned known fire limiters work in conjunction with such a trigger system, but require greater incursions and particularly the provision of additional catch pawls. In a preferred embodiment of the fire limiter of the invention, the wheel ratchet for the interruption of the firing simply engages with a trip releasing catch, mounted pivotally in the trigger, which catch supports the sear pivoted on the same axis as the trigger. The ratchet pulls this trip-releasing catch away from the trigger lever so that the trigger lever is free to fall into the hammer notch provided therefor. Accordingly, no additional member needs to be provided that holds the hammer after the interruption of the firing and must be released by means of the trigger mechanism, but rather the directly available sear is also used for the interruption of the firing.

The trip-releasing catch thus takes the place of a stationary stop for the sear hitherto provided in the trigger.

BRIEF DESCRIPTION OF THE DRAWINGS

The invention is described and explained in greater detail below on the basis of the embodiment represented in the drawing. The features seen in the description and the drawing can be applied in other embodiments of the invention each by itself or in any desired combination.

In the drawings.

DETAILED DESCRIPTION OF ILLUSTRATED EMBODIMENT

Figure 1:
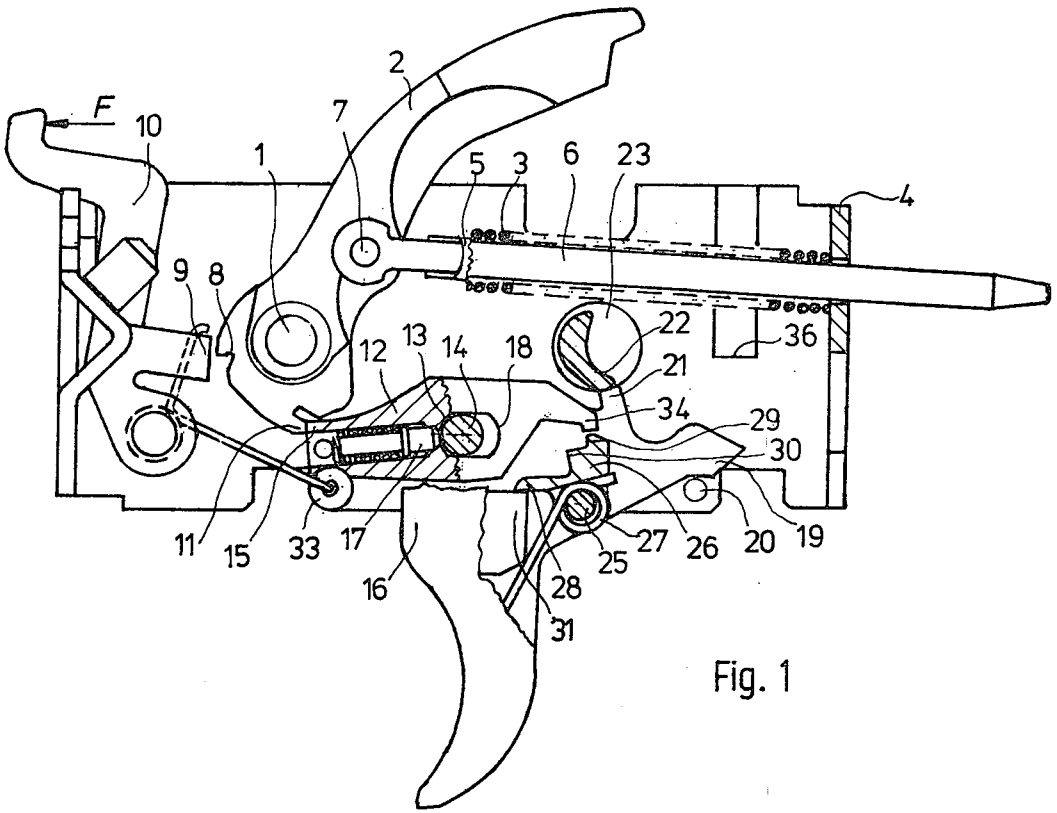
FIG. 1 shows a schematic representation of a trigger mechanism with a trip-releasing catch intended for use in conjunction with a fire limiter.

The trigger mechanism shown in the drawing comprises a hammer 2, supported on a shaft 1 in a trigger case 4. The hammer 2 is loaded by a compression spring 3 which abuts at one end on a wall of the trigger case 4 and at the other end on the forked head 5 of a rod 6. The forked head 5 is connected by means of a thrust bearing 7 with the hammer 2.

After the cocking of the hammer 2 by means of the not shown breech of the firearm, the hammer is first latched by a catch pawl 10 having an arm 9 which engages a detent 8 on the hammer 2. If the breech assumes the closure position, the catch pawl 10 is deflected in the direction of the arrow F, so that the arm 9 of the catch pawl 10 releases the detent 8 of the hammer, as shown in FIG. 1. With the trigger not activated, the hammer 2, then, as likewise seen in FIG. 1, is held in the cocked position by a sear 12 having an arm 15 which engages in a detent 11 on the hammer 2.

The sear 12 is carried in the trigger case 4 on the same shaft 14 as the trigger 16. The sear 12 has for its seating on the shaft 14 a slot and braces itself with the slot half 13, closer to the hammer, engaged against the bearing shaft 14, when the sear 12 is engaged with the hammer 2. In the sear 12 there is located a spring-loaded pin 17 which tends to move the trigger lever 12 in its longitudinal direction vis-a-vis the shaft in such a way that the other slot half 18, more remote from the hammer 2, comes into contact with the shaft 14. Further, the sear 12 is pressed on its arm 15 facing the hammer 2 by a spring-loaded roller 33 in the direction of the hammer 2 and held engaged with the detent 11 of the hammer 2 when the trigger is unactivated.

The trigger 16, supported on the shaft 14, is loaded in clockwise direction by means of a not shown spring, so that an arm portion 19 of the trigger 16 in its normal position is in contact with a stop dog 20. The trigger 16 has a projection 21 that works in conjunction with a cam 22 on the safety shaft 23 supported rotationally in the trigger casing 4. Furthermore, in a hollow portion of the trigger 16, there is supported on a pin 25 a swingable trip-releasing catch 26 which is loaded in the counterclockwise direction by means of a spring 27. In its rest position, the trip-releasing catch 26 is braced with its arm 28 against a stop 31 disposed in the trigger 16.

In the position of the safety shaft 23 shown in FIG. 1, the weapon is secured. The arm 21 of the trigger 16 is in contact with the outside of the cam 22 and can therefore not be moved out of the position shown. Therefore, neither can the sear 12 be moved out of the detent 11 on the hammer, so that the hammer is held fast in the position shown in FIG. 1. By turning the safety shaft clockwise, the cam 22 can be moved to a greater or lesser distance out of the path of the arm 21 of the trigger 16, thereby setting the trigger mechanism on single shot or continuous fire. Between the setting for single shot and continuous fire, there is the setting "triple shot", which is shown in FIGS. 2 to 4 and in which the trigger 16 can be moved so far that it comes up with its arm 19 against a stop 36 mounted in the trigger casing 4.

If the trigger 16 is activated on a weapon with the safety off, upon the swivelling of the trigger, the sear 12 is driven by a projection 29 on the trip releasing catch 26. Such projection 29 comes into contact with the arm 34 of the sear 12. As soon as the arm 15 of the sear 12 is free from the detent 11 of the hammer 2, the spring-loaded pin 17 moves the trigger lever 12 vis-a-vis the shaft 14 and therewith vis-a-vis the trigger 16 and its trip-releasing catch 16, so that the lever arm 34 slides off the projection 29 of the trip releasing catch 26 and comes to rest on the shoulder 30 of the trip releasing catch. At the same time, the sear 12 executes a clockwise pivoting which brings its arm 15 into engagement again with the detent 11 of the hammer 2, if the pivot angle of the trigger 16 is limited to its single slot position by the setting of the cam 22 in a manner not shown in further detail.

Figure 2:
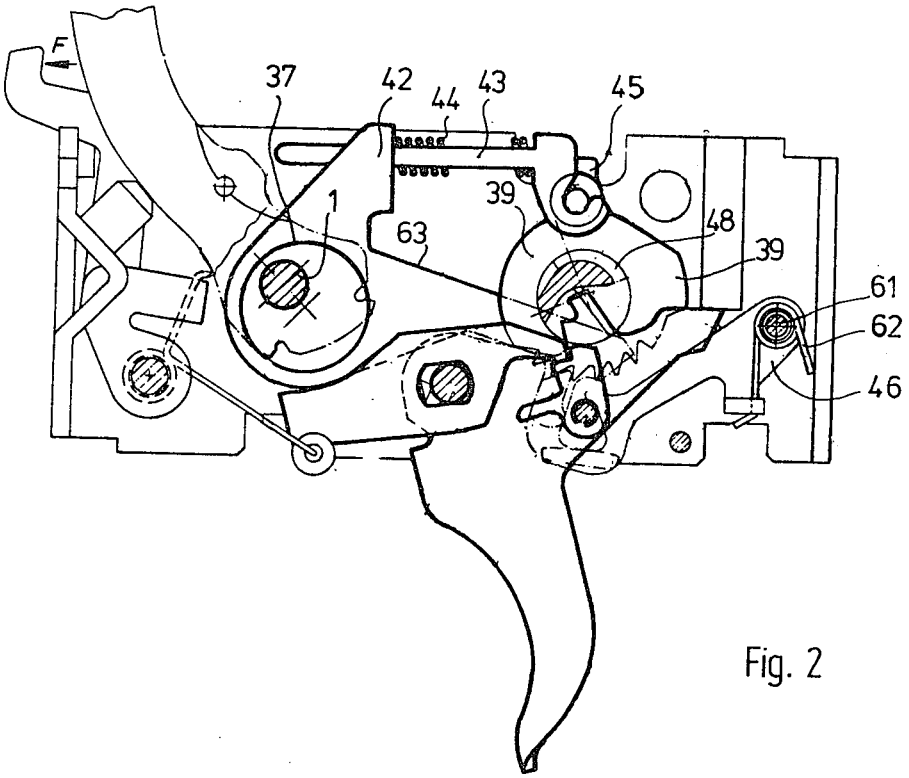
FIGS. 2 and 3 show schematic representations of various parts of a fire limiter incorporated into the trigger mechanism of FIG. 1 after release of the first shot with pulled trigger.
Figure 3:
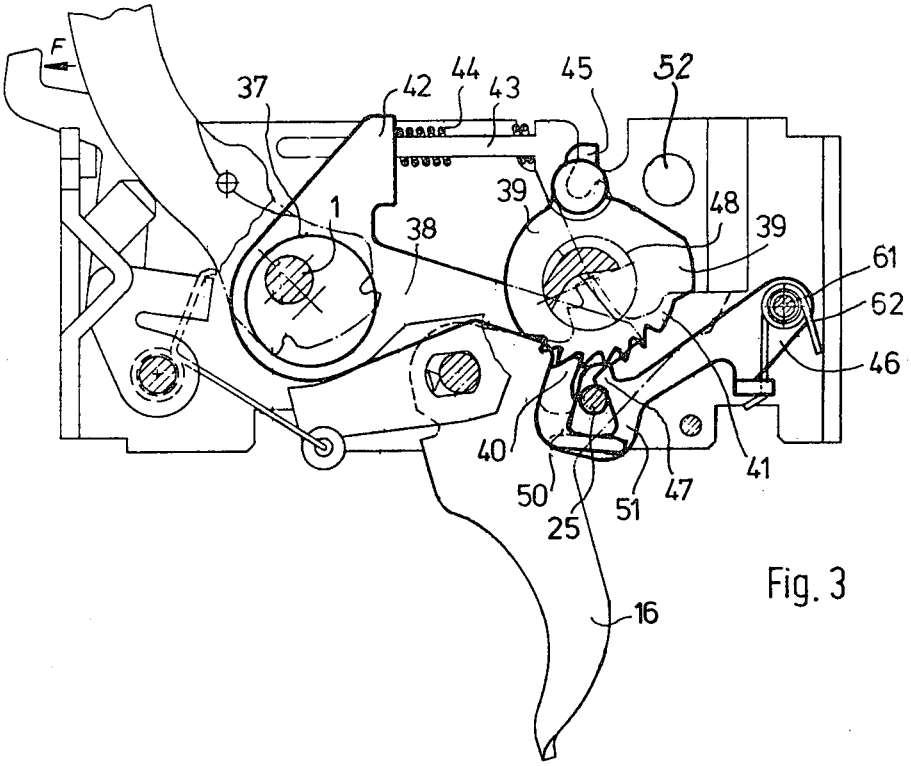
Figure 4:
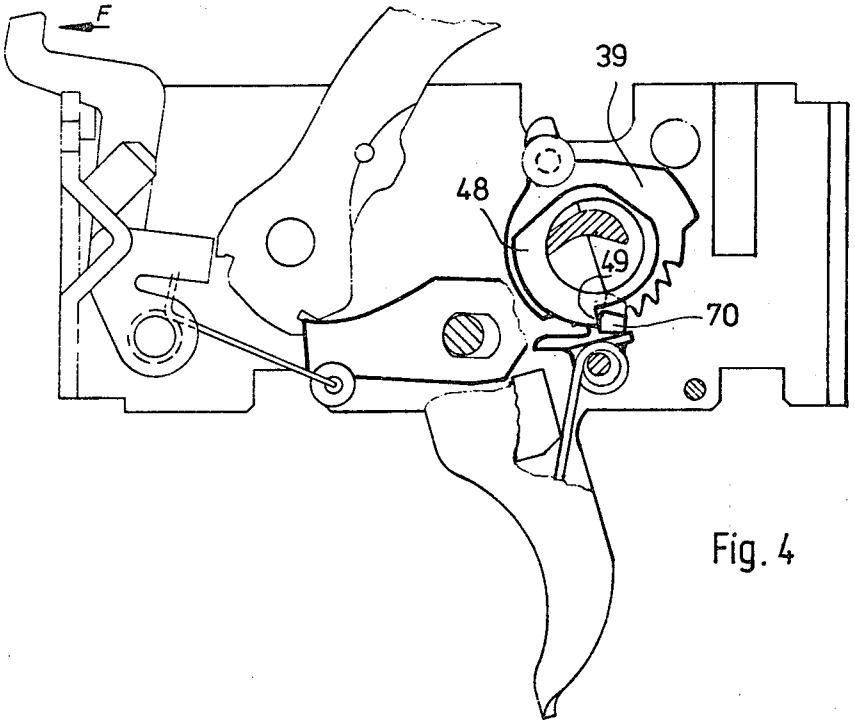
FIG. 4 shows a representation corresponding to FIGS. 2 and 3, but showing the position of the parts after the last shot.

In the cam setting on "triple shot" shown in FIGS. 2 to 4, however, the arm 15 is also held out of engagement with the hammer 2 if the arm 34 of the sear 12 has slid off the projection 29 and lies on the shoulder 30. Now comes into action the fire limiter represented in FIGS. 2 to 4, which has a rotating wheel ratchet 39 supported concentrically to the safety shaft 23 by means of a hollow hub 48 in the trigger casing. This wheel ratchet 39 works together with a pawl 38 which is installed on a bearing 37 located on the hammer 2 eccentrically to the shaft 1. The eccentricity of the bearing 37 is such that with each firing movement of the hammer 2, the wheel ratchet 39 is advanced by a ratchet tooth 40 on the pawl 38, through an angle corresponding to the angular extent of one of its teeth 41. The pawl 38 is provided with a laterally extending arm 42 which extends essentially parallel to an arm 45 on the wheel ratchet 39. Between these two arms 42 and 45 there is disposed a compression spring 44 on a spring rod 43. The spring rod 43 is suspended pivotally at one end on the arm 45 of the wheel ratchet 39 and is supported slidably at its other end on the arm 42 of the pawl 38. The compression spring 44 exerts such torques on the arms of the pawl 38 and the wheel ratchet 39 that, on the one hand, the pawl 38 tends to engage the wheel ratchet, with the ratchet tooth 40 of the pawl 38 between the teeth 41 of the wheel ratchet, while, on the other hand, the wheel ratchet 39 tends to execute a clockwise rotation. Also working in conjunction with the teeth 41 is a stop pawl 46 that likewise is pivotally supported in the trigger casing 4 on a shaft 61 and is loaded by a spring 62 which tends to hold the tooth 47 of the stop pawl 46 engaged with the teeth 41 of the wheel ratchet 39.

As already mentioned, in the case of the three-shot setting, with each firing movement of the hammer from the cocked position shown in FIG. 1 to the striking position shown in FIGS. 2 and 3, under the impetus of the compression spring 3, the wheel ratchet 39 is advanced one tooth each time. The advancing movement takes place over the entire striking movement of the hammer and takes place only under the accurately defined influence of the compression spring loading the hammer. The advance of the wheel ratchet takes place therefore relatively slowly and smoothly so that the problem-free advance of the wheel ratchet is insured with every shot.

After a number of shots determined by the number of teeth, in the embodiment shown after three shots, a projection 49 on the hollow hub 48 of the wheel ratchet 39 engages with a lateral stop 70 on the trip-releasing catch 26 and pivots the trip-releasing catch 26, as seen in FIG. 4, so far that the trip-releasing catch 26 is pulled out with its shoulder 30 away from the arm 34 of the sear 12, and thereby the sear 12 is pivoted clockwise again under the effect of the springloaded roller 33 so far that its arm 15 engages with the projection 11 of the hammer 2 if, after the release of the shot, the hammer 2 is cocked by the returning breech. Since the entire time of the shot release and the breech return lies between the release of the trigger lever 12 and the catching of the hammer 2, there is assurance that the sear 12 will reach the capture position at the right time and will engage securely with the hammer 2, in order to latch it after the completion of the desired firing cycle.

Upon release of the trigger, as seen in FIG. 3, the extension of the bearing pin 25 for the trip-releasing catch 26, protruding laterally from the trigger 16, engages with the arms 50 and 51 of the pawl 38 and the stop pawl 46 and retracts these two pawls away from the wheel ratched so that the wheel ratchet, under the effect of the compression spring 44, can return to its original position in which its arm 45 is in contact with a stop 52.

When the trigger is pulled again, the firing cycle, determined by the fire limiter, is repeated.

As can be seen particularly from FIGS. 2 and 3, the pawl 38 has an edge 63 which engages in a recess provided for this purpose in the safety shaft 23. With a setting on continuous fire, the safety shaft is turned so far that the pawl 38 lies with its edge 63 against the outermost peripheral portion of the safety shaft and is thereby held out of engagement with the wheel ratchet 39. Therefore, the fire limiter does not come into play in the case of continuous fire, and the firing is interrupted only upon release of the trigger 16.

It goes without saying that the invention is not limited to the described embodiment, but derivations from it are possible without exceeding the scope of the invention. Thus, for example, instead of the eccentric for driving the pawl, some kind of crank drive can be used, and the pawl and the wheel ratchet can be loaded by springs independent of each other. Also, the advance of the wheel ratchet could be derived from the cocking movement of the hammer. Finally, also the interruption of the firing could be effected by means of other components than the trip-releasing catch located in the trigger. The embodiment shown does, though, offer an optimum with respect to simplicity of construction, small space requirement and reliability.

I claim:

1. A fire limiting mechanism for an automatic firearm, comprising a detonating hammer movable in opposite directions between cocked and fire positions, a spring biasing said hammer toward said fire position, a movable trigger for releasing said hammer from said cocked position for movement to said fire position, a rotatable wheel ratchet having a plurality of ratchet teeth spaced apart by a predetermined interval, an actuating pawl having a pivotal connection to said hammer and movable in opposite directions with said hammer, said actuating pawl having a pawl tooth for engaging said teeth of said wheel ratchet to index said wheel ratchet through the interval of one tooth for each complete movement of said hammer in one direction, a movable stop pawl having a spring for biasing said stop pawl against said wheel ratchet to maintain said wheel ratchet in its indexed position after being indexed by said actuating pawl, fire disconnecting means operable to arrest said hammer in its cocked position, and an element operable by said wheel ratchet after said wheel ratchet is indexed through a predetermined number of steps for actuating said fire disconnecting means to arrest said hammer in its cocked position, said pivotal connection between said hammer and said actuating pawl being connected to said hammer at a location having a range of movement corresponding substantially with the interval between the teeth of said wheel ratchet whereby said actuating pawl transfers substantially the entire movement of said hammer at said location to said wheel ratchet during each complete movement of said hammer in one direction.

2. A fire limiting mechanism according to claim 1, said pawl tooth and said ratchet teeth being oriented such that said pawl indexes said wheel ratchet during the movement of said hammer between said cocked position and said fire position.

3. A fire limiting mechanism according to claim 1, including a hammer pivot supporting said hammer for swinging movement between said cocked position and said fire position, said pivotal connection between said hammer and said actuating pawl including a bearing disposed eccentrically on said hammer relative to said hammer pivot, said actuating pawl being pivotally received on said bearing.

4. A fire limiting mechanism according to claim 3, including approximately parallel arms on said actuating pawl and said wheel ratchet, and a common compression spring disposed between said approximately parallel arms, said compression spring biasing said actuating pawl toward engagement with said wheel ratchet while also tending to return said wheel ratchet to its initial position.

5. A fire limiting mechanism according to claim 4, including a spring rod for receiving and supporting said compression spring between said approximately parallel arms.

said spring rod being linked to the arm of the wheel ratchet, the arm of the actuating pawl having an opening therein which is penetrated by said spring rod.

6. A fire limiting mechanism according to claim 1, said trigger having a trigger shaft pivotally supporting said trigger, said trigger having a sear installed on said trigger shaft, said hammer having a detent engageable by said sear for initially arresting said hammer in its cocked position, said trigger having a trip-releasing catch pivotally supported on said trigger and engageable with said sear for disengaging said sear from said detent when said trigger is actuated, said trip-releasing catch having latching means for latching said sear out of engagement with said detent on said hammer, said sear and said catch also being components of said fire disconnecting means, said fire disconnecting means also including an element on said catch engageable by said element operable by said wheel ratchet after said wheel ratchet is indexed through such predetermined number of steps for moving said catch away from said sear to release said sear for return movement into the path of said detent on said hammer to arrest said hammer in its cocked position, said sear having spring means biasing said sear for such return movement.

7. A fire limiting mechanism according to claim 6, said pawl tooth and said ratchet teeth being oriented such that said pawl indexes said wheel ratchet during the movement of said hammer between said cocked position and said fire position, whereby the entire time required for return movement of said hammer is available for the operation of said fire disconnecting means.

8. A fire limiting mechanism according to claim 1, including a safety shaft for selectively enabling and disabling said trigger, said wheel ratchet having means pivotally supporting said wheel ratchet concentrically with respect to said safety shaft.

9. A fire limiting mechanism according to claim 8, in which said safety shaft is rotatably adjustable to a continuous fire setting, said safety shaft having a control surface engageable with said actuating pawl for moving said actuating pawl out of engagement with said wheel ratchet to prevent indexing movement of said wheel ratchet by said actuating pawl.

10. A fire limiting mechanism for an automatic firearm, comprising a detonating hammer having a hammer pivot swingably supporting said hammer for swinging movement in opposite directions between cocked and fire positions, a spring biasing said hammer toward said fire position, a pivotally movable trigger for releasing said hammer from said cocked position for movement by said spring to said fire position, a rotatable wheel ratchet having a plurality of ratchet teeth spaced apart by a predetermined interval, an actuating pawl having a pivotal connection to said hammer and movable in opposite directions with said hammer, said pivotal connection including an eccentric bearing disposed eccentrically on said hammer relative to said hammer pivot, said actuating pawl being directly and pivotally received on said eccentric bearing, said actuating pawl having a pawl tooth for engaging said ratchet teeth of said wheel ratchet, said pawl tooth and said ratchet teeth being oriented to index said wheel ratchet through the interval of one tooth for each complete swinging movement of said hammer between said cocked position and said fire position, a movable stop pawl having a spring for biasing said stop pawl against said wheel ratchet to maintain said wheel ratchet in its indexed position after being indexed by said actuating pawl, fire disconnecting means operable to arrest said hammer in its cocked position, and an actuating element operable by said wheel ratchet after said wheel ratchet is indexed through a predetermined number of steps for actuating said fire disconnecting means to arrest said hammer in its cocked position, said pivotal connection afforded by said eccentric bearing between said hammer and said actuating pawl being disposed on said hammer at a location affording a range of movement corresponding substantially with the interval between the teeth of said wheel ratchet whereby said actuating pawl transfers substantially the entire movement of said hammer at said location to said wheel ratchet during each complete swinging movement of said hammer between its cocked and fire positions, the entire time required for such swinging movement of said hammer thereby being employed for the indexing movement of said wheel ratchet.

11. A fire limiting mechanism according to claim 10, including approximately parallel arms on said actuating pawl and said wheel ratchet, and a common compression spring disposed between said approximately parallel arms for biasing said actuating pawl toward engagement with said wheel ratchet while also tending to return said wheel ratchet to its initial position.

12. A fire limiting mechanism according to claim 11, including a spring rod for receiving and supporting said compression spring between said approximately parallel arms, said spring rod being linked to one of said arms, the other of said arms having an opening therein which is penetrated by said spring rod.

13. A fire limiting mechanism according to claim 10, said trigger having a trigger shaft pivotally supporting said trigger, said trigger having a sear installed on said trigger shaft, said hammer having a detent engageable by said sear for initially arresting said hammer in its cocked position, said sear having spring means biasing said sear toward said hammer, said trigger having a trip-releasing catch pivotally supported on said trigger and engageable with said sear for disengaging said sear from said detent when said trigger is actuated, said trip-releasing catch having latching means for latching said sear out of engagement with said detent on said hammer, said sear and said catch also being components of said fire disconnecting means, said fire disconnecting means also including an element on said catch engageable by said actuating element operable by said wheel ratchet after said wheel ratchet is indexed through such predetermined number of steps for moving said catch away from said sear to release said sear for return movement by its biasing means into the path of said detent on said hammer to arrest said hammer in its cocked position.

14. A fire limiting mechanism according to claim 10, including a rotatable safety shaft for selectively enabling and disabling said trigger, said wheel ratchet having means pivotally supporting said wheel ratchet concentrically with respect to said safety shaft.

15. A fire limiting mechanism according to claim 14, in which said safety shaft is rotatably adjustable to a continuous fire setting, said safety shaft having a control surface engageable with said actuating pawl for moving said actuating pawl out of engagement with said wheel ratchet to prevent indexing movement of said wheel ratchet by said actuating pawl.

* * * * *